US006478666B1

(12) United States Patent
Berger et al.

(10) Patent No.: US 6,478,666 B1
(45) Date of Patent: Nov. 12, 2002

(54) GUIDING CART FOR A MANUALLY GUIDED TOOL, ESPECIALLY AN ABRASIVE CUT-OFF MACHINE

(75) Inventors: Rudolf Berger, Grünwald (DE); Wolfgang Schmid, Munich (DE); Peter Heubeck, Ilmmünster (DE); Adam Ruff, Neufahrn (DE); Rochus Gold, Freising (DE); Thomas Bromberger, Train (DE)

(73) Assignee: Wacker-Werke GmbH & Co. KG, Munich (DE)

( * ) Notice: Subject to any disclaimer, the term of this patent is extended or adjusted under 35 U.S.C. 154(b) by 0 days.

(21) Appl. No.: 09/622,332

(22) PCT Filed: May 5, 1998

(86) PCT No.: PCT/EP99/03084

§ 371 (c)(1),
(2), (4) Date: Aug. 9, 2000

(87) PCT Pub. No.: WO99/56909

PCT Pub. Date: Nov. 11, 1999

(30) Foreign Application Priority Data

May 5, 1998 (DE) ..... 198 20 029

(51) Int. Cl.[7] ..... B24B 23/02

(52) U.S. Cl. ..... 451/344; 125/13.01; 30/371

(58) Field of Search ..... 451/344, 350, 451/352, 353, 434; 125/13.01, 13.03, 14; 299/39.3; 30/371, 122

(56) References Cited

U.S. PATENT DOCUMENTS

| | | | | | |
|---|---|---|---|---|---|
| 2,673,725 | A | * | 3/1954 | Coates | 125/13.01 |
| 2,736,311 | A | * | 2/1956 | Coates | 125/13.01 |
| 3,301,601 | A | * | 1/1967 | Zuzelo | 299/39.3 |
| 4,188,935 | A | * | 2/1980 | Tubesing | 125/13.01 |
| 5,106,117 | A | * | 4/1992 | Wang | 280/646 |
| 5,857,684 | A | * | 1/1999 | Liao et al. | 280/40 |
| 6,019,433 | A | | 2/2000 | Allen | |
| 6,112,736 | A | * | 9/2000 | Bearden | 125/13.01 |

FOREIGN PATENT DOCUMENTS

DE 70 40 737 U 5/1971

* cited by examiner

*Primary Examiner*—Robert A. Rose
(74) *Attorney, Agent, or Firm*—Boyle Fredrickson Newholm Stein & Gratz S.C.

(57) ABSTRACT

The invention relates to a guiding cart for a manually guided tool, for example an abrasive cut-off machine, which comprises a movable frame on which a first and a second locating recess for inserting the abrasive cut-off machine are provided. A locking device is assigned to the first recess by means of which forces can be applied to the abrasive cut-off machine in the direction of the first locating recess and the second locating recess. In this way the abrasive cut-off machine can be reliably and rapidly fixed to the guiding cart after it has been inserted into the locating recesses. The insertion of the abrasive cut-off machine is facilitated by inclined inserting elements situated in the locating recesses.

24 Claims, 9 Drawing Sheets

GUIDING CART FOR A MANUALLY GUIDED TOOL, ESPECIALLY AN ABRASIVE CUT-OFF MACHINE

BACKGROUND OF THE INVENTION

1. Field of the Invention

The invention relates to a guide carriage for a cutting implement which can be guided by hand such as a parting-off grinder.

2. Description of the Related Art

Guide carriages of this kind are suitable, in particular, for carrying and guiding parting off grinders. Parting-off grinders or "cutting implements" which can be guided by hand, especially diamond parting-off grinders, are generally used when cutting pipes, stone slabs etc. and are suitable for carrying out work rapidly at different locations, even in spatially restricted conditions, by virtue of their low weight and ease of handling. The range of applications of a parting-off grinder of this kind is extended by the fact that it is secured on a guide carriage. This opens up the possibility of making precise cuts of defined depth in asphalt or concrete.

For this purpose, the parting-off grinder is generally secured on the guide carriage with the aid of lugs and bolts, this being very time-consuming and sometimes completely impossible because of the lack of suitable tools on site.

U.S. Pat. No. 4,938,201 has disclosed a guide carriage for a parting-off grinder which can be guided by hand, having a mobile frame and a holding device, mounted on the frame, for holding the parting-off grinder.

DE 30 00 390 has disclosed a guide carriage which comprises a mobile frame which rises on one side in the form of a pushing bar to a height at which it can be gripped by the operator. An implement designed as a parting-off grinder is arranged on the guide carriage.

DE 70 40 737 U has disclosed a guide carriage for a parting-off grinder having a mobile frame and a guide bar which rises from the frame to a handle, and having a holding device, mounted on the frame, for holding the implement. The holding device has a first holder on the guide bar and a second holder for supporting the implement on the frame.

OBJECTS AND SUMMARY OF THE INVENTION

The object underlying the invention is to specify a guide carriage in the case of which the implement can be secured quickly and reliably and in a simple manner.

According to the invention, the object is achieved by means of a guide carriage having a guide carriage for a cutting implement. The guide carriage includes a mobile flame and a holding device which is mounted on the frame and which has a first holder and a second holder for supporting the implement on the frame. The first and second holders include first and second receptacles, respectively, for insertion of the implement therein. The first receptacle is assigned a locking device, with a stop which has at least one stop surface which can be moved relative to the frame and aligned to strike the implement, such that a perpendicular vector associated with the orientation of the stop surface has a directional component extending in a direction of extension of at least one of the first and second receptacles.

A guide carriage configured in this way therefore has at least one stop surface by means of which forces in the direction of the first and the second receptacle can be produced in the case of an implement used, by virtue of the corresponding alignment. In general, this is made possible by appropriate sloping of the stop surface. As an alternative, the stop can also have a plurality, e.g. two, stop surfaces, the first stop surface being oriented in the direction of the first receptacle and the second stop surface being oriented in the direction of the second receptacle. In this case too, a combination of the two perpendicular vectors perpendicular to the stop surfaces has directional components in the direction of the first and the second receptacle. However, it is advantageous if each of the receiving surfaces assumes a fixing and clamping function assigned to it.

This makes it possible to fix the implement reliably in the holding device with the aid of just one locking device.

To ensure reliable fixing in the first receptacle, it is particularly advantageous if the first stop surface is arranged opposite a bottom surface of the first receptacle. It is furthermore very expedient if the second receptacle has supporting surfaces which are arranged in such a way that the second receptacle allows only a relative movement of the implement in the direction of the first receptacle. It is namely possible, by restricting the degrees of freedom in the second receptacle in this way, to hold the implement reliably in the second receptacle by means of the force produced in the direction of the second receptacle by the second stop surface.

A very advantageous development of the invention consists in a guide surface being provided on the second receptacle, opposite a bottom surface, thereby making it particularly easy to restrict the degrees of freedom.

In a particularly advantageous embodiment of the invention, the first and the second receptacle have guide surfaces which slope counter to a direction of insertion of the implement. The insertion slopes thereby formed make it easier to insert the implement into the holding device and ensure definite and play-free seating.

The locking device can be operated comfortably if the first receptacle is arranged close to a handle for guiding the guide carriage.

In another particularly advantageous embodiment of the invention, the locking device has a pivoting interlock element which bears the first and the second stop surface, it being very expedient if the first stop surface is formed by a hold-down element formed on the pivoting interlock element and the second stop surface is formed by an eccentric which is arranged about a pivot axis of the pivoting interlock element. By pivoting the pivoting interlock element after inserting the implement, the stop surfaces can be moved equally quickly and precisely up to or over the implement, the stop surfaces thereby ultimately pressing the implement into the receptacles. By means of the eccentric, in particular, the implement is pressed over its entire length into the second receptacle.

In another embodiment, the locking device provided is one in which the pivoting interlock element has just one single stop surface, which produces a force with components in the direction of the first and the second receptacle. The pivoting interlock element can be pivoted up laterally over the handle of the implement, thereby giving a compact construction. It is advantageous if a throttle actuator is also provided on the pivoting interlock element, with the aid of which actuator the implement can be remote-controlled via the throttle lever.

In a particularly advantageous development of the invention, a safety button provided on the implement can be actuated by means of the first stop surface. To operate the implement, e.g. a parting-off grinder, safety buttons of this kind must be operated in addition to an on/off switch in order to avoid the implement being switched on accidentally. However, this problem is not encountered when the implement is clamped in the guide carriage, and it is thus possible for the safety button to be permanently pressed by being acted upon by the first stop surface.

BRIEF DESCRIPTION OF THE DRAWINGS

These and other features and advantages of the invention will be explained in greater detail below using the accompanying figures, in which.

DETAILED DESCRIPTION OF THE PREFERRED EMBODIMENTS

Figure 1:
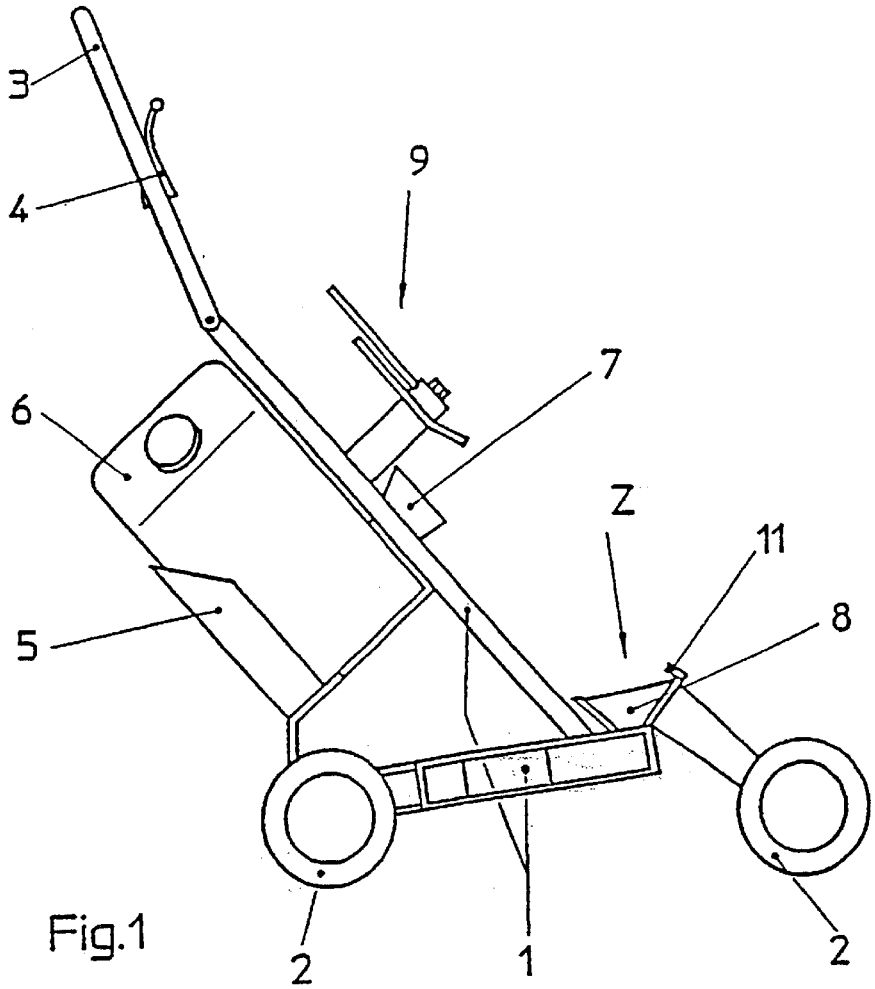
FIG. 1 shows a schematic side view of a guide carriage according to the invention.

FIG. 1 shows a schematic side view of the guide carriage according to the invention.

The guide carriage essentially comprises a frame 1, which is welded together from tubes or metal sheets and can be moved on rollers 2. Secured on the frame 1 is a pivotable handle 3, using which the guide carriage can be moved over concrete or asphalt, for example, and on which a throttle lever 4 for controlling the parting-off grinder (not shown) to be inserted into the guide carriage is provided.

Also mounted on the frame 1 is a holder 5 with a water tank 6, from which water is fed to the parting-off location in a customary manner via hoses or tubes (not shown).

A holding device for holding the parting-off grinder is furthermore mounted on the frame 1, said holding device comprising a first receptacle 7 and a second receptacle 8. The first receptacle 7 is assigned a locking device 9, the operation of which will be described below.

The first receptacle 7 essentially comprises two sheet-metal tabs which project from the frame 1 and into which part of the handle of the parting-off grinder can be inserted.

Figure 2:
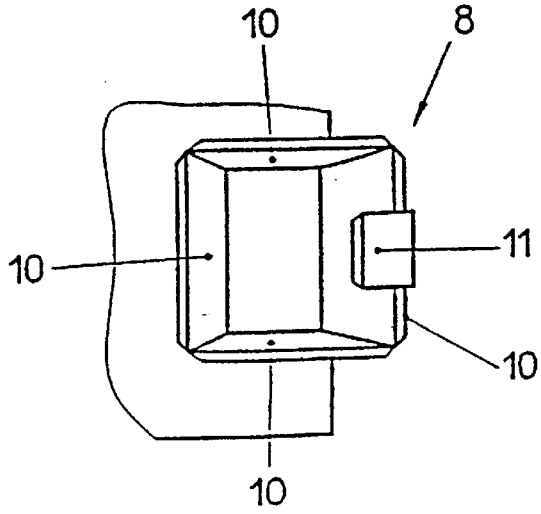
FIG. 2 shows a detail looking in direction Z in FIG. 1.

In FIG. 2, the second receptacle 8 is illustrated in the form of an enlarged plan view looking in direction Z in FIG. 1. It comprises sheet-metal pieces 10 which taper obliquely downward relative to one another and thereby forms a shell shape. An extension 11, the operation of which will be explained below, is formed on one of the sheet-metal pieces 10. The second receptacle 8 is illustrated in FIG. 1 in the form of a partial section. However, as can be seen from FIG. 2, it has sheet-metal pieces 10 on all four sides.

Figure 3:
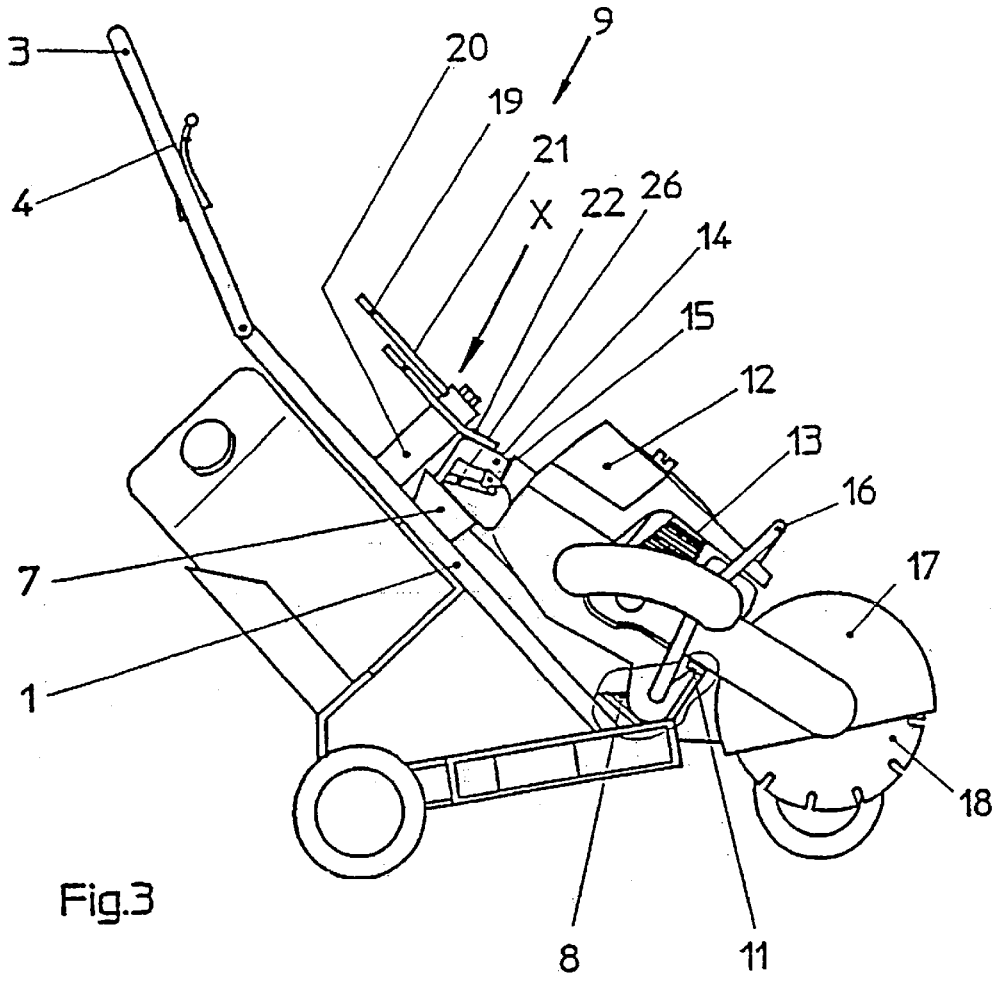
FIG. 3 shows a side view of the guide carriage according to the invention from FIG. 1 with a parting-off grinder inserted.

FIG. 3 shows the guide carriage from FIG. 1 with a parting-off grinder 12 inserted.

The commercially available parting-off grinder 12 with a frame or casing, an internal combustion engine 13, a handle 14, a throttle-actuating means 15, a guiding and supporting bar 16 and a diamond parting-off or cutting wheel 18 arranged underneath a protective hood 17 is inserted into the first receptacle 7 and the second receptacle 8.

Figure 4:
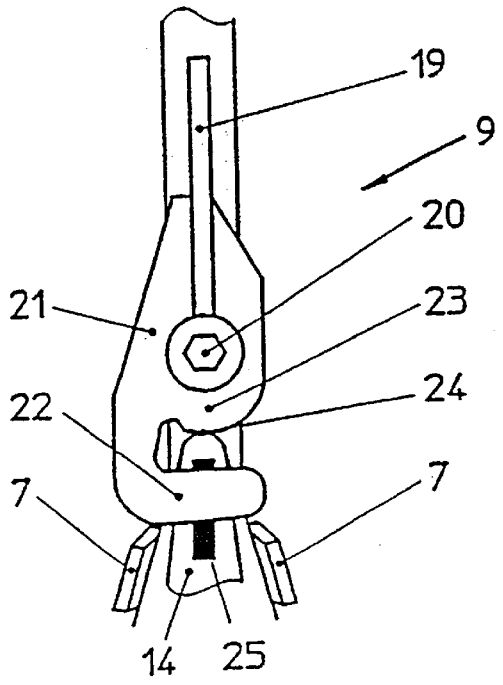
FIG. 4 shows an enlarged detail looking in direction X in FIG. 3.

In the plan view in FIG. 4, the locking device 9, which is illustrated in the closed condition in FIG. 3, is illustrated on an enlarged scale looking in direction X. It comprises a handle 19, which can be pivoted about an axis of rotation 20 and is coupled to a pivoting interlock element 21 acting as a stop. The pivoting interlock element 21 is hook-shaped and bears a hold-down element 22 acting as a first stop surface and an eccentric 23 acting as a second stop surface.

As can be seen in FIGS. 3 and 4, the pivoting interlock element 21 can be turned in such a way by actuating the handle 19 that the parting-off grinder 12 can be inserted into the two freely accessible receptacles 7, 8. This is made easier by the fact that both receptacles 7, 8 have insertion slopes in the form of obliquely angled metal sheets. In this case, a front part of the parting-off grinder housing enters the second receptacle 8, the extension 11 being able to enter a corresponding recess in the parting-off grinder 12. As a result, the parting-off grinder 12 can be pulled or pivoted out of the second receptacle 8 only in the direction of the first receptacle 7. To make the illustration clearer, the sheet-metal piece 10 of the second receptacle 8, said sheet-metal piece being at the top in relation to the plane of the drawing, has been omitted.

During insertion, the handle 14 of the parting-off grinder 12 moves between the two sheet-metal pieces of the first receptacle 7. The sheet-metal pieces of the first receptacle 7, said pieces being visible in FIG. 4, are joined by a bottom surface, which is obscured by the handle 14 and is therefore not visible. The hold-down element 22 is arranged essentially opposite the bottom surface.

Once the parting-off grinder 12 has been inserted into the two receptacles 7, 8, the parting-off grinder 12 is positioned without play and in a precise manner relative to the frame 1. In this state, it is only possible for it to be lifted upward out of the first receptacle 7 and thus pulled or pivoted out of the second receptacle 8.

To finally secure the parting-off grinder 12, the pivoting interlock element 21 is pivoted into the position shown in FIGS. 3 and 4 by actuating the handle 19. The hold-down element 22 thereby moves over the handle 14 of the parting-off grinder and presses the latter into the first receptacle 7 against the two lateral sheet-metal pieces by virtue of a beveled slope on the hold-down element 22. During this process, there should be no contact between the handle 14 and the bottom surface connecting the two sheet-metal pieces, so as to achieve adequate preloading. If the handle 14 does touch the bottom surface, however, the preloading must be achieved by means of corresponding elasticity of the hold-down element 22.

As the pivoting interlock element 21 is pivoted, the eccentric 23 also makes contact with a rear end 24 of the handle 14 and, as the pivoting interlock element 21 is pivoted further, presses the handle 14 and thus the parting-off grinder 12 into the second receptacle 8. By virtue of the preloading in the direction of the first and the second receptacle 7, 8, the parting-off grinder 12 is held with the highest possible accuracy on the frame 1. The preloading ensures that lifting of the parting-off grinder 12 out of one of the receptacles 7, 8 can be avoided even in operation and with cutting forces acting via the parting-off wheel 18.

The locking device 9 can be supplemented by a latching device (not shown), by means of which the pivoting interlock element 21 can be fixed at least in the locking position, thus making it possible to avoid unintentional release of the pivoting interlock element 21. Other embodiments of the locking device 9, in which the two stop surfaces 22, 23 can be moved relative to the frame 1, are also conceivable instead of the pivoting interlock element 21 shown. Thus, for example, each of the surfaces can be coupled to a screw thread, thus allowing the stop surfaces to be adjusted toward the parting-off grinder 12 by turning corresponding handles or wing nuts or the like. It is likewise readily possible for the person skilled in the art to replace the pivoting interlock element by a wedging means.

Conventional parting-off grinders have, in the region of the handle 14, a safety button 25 which the operator must keep pressed simultaneously with the throttle-actuating means 15. Only then can the parting-off wheel 18 be set in motion by the internal combustion engine 13. However, this safety aspect is only significant when the parting-off grinder 12 is guided by hand, whereas operation of the safety button 25 is more of a hindrance when it is used in the guide carriage. For this reason, the pivoting interlock element 21 is designed in such a way that it not only presses the handle 14 into the first receptacle 7 by means of the hold-down element 22 but also simultaneously operates the safety button 25.

As a supplement to the description, it may be stated that the throttle lever 4 on the handle 3 of the guide carriage is coupled by a Bowden cable (not shown) to a lever 26 which is in contact with the throttle-actuating means 15 of the parting-off grinder 12. This makes it possible to control the internal combustion engine 13 remotely from the handle 3.

Figure 5:
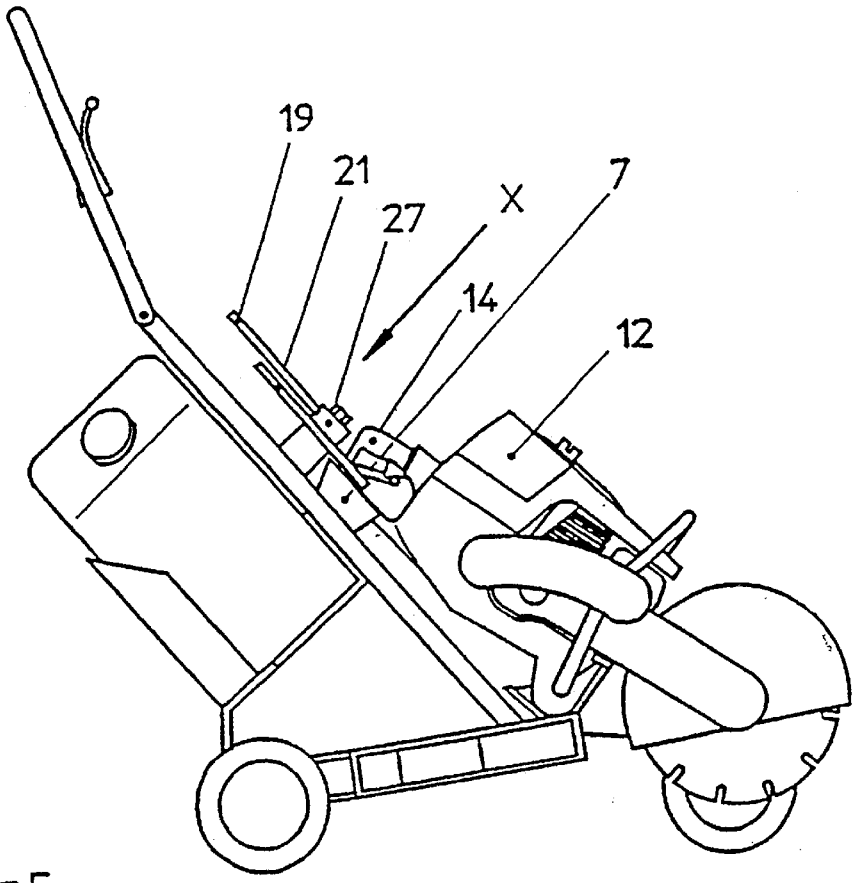
FIG. 5 shows a second embodiment of the guide carriage according to the invention with the parting-off grinder inserted.
Figure 6:
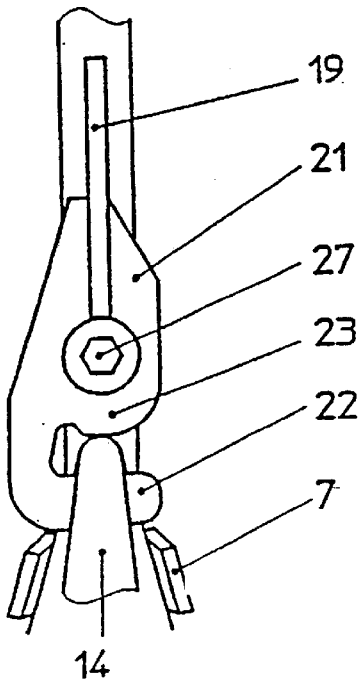
FIG. 6 shows an enlarged detail looking in direction X in FIG. 5.

FIGS. 5 and 6 show a guide carriage corresponding to FIGS. 3 and 4 but with a modification. Here, a shorter pivot axis 27 than the pivot axis 20 in FIG. 3 is formed. This allows the hold-down element 22 of the pivoting interlock element 21 to make contact with a lower region of the usually bow-shaped handle 14 of the parting off grinder 12. The parting-off grinder 12 is thereby pressed into the first receptacle 7, as already described in conjunction with FIG. 3. Here, the eccentric 23 operates in the same way.

As compared with the embodiment described first, this variant has the advantage of a more compact construction. However, an additional clamping device is required to hold down the safety button 26 on the handle 14 of the parting-off grinder 12.

The remaining components correspond to those already described with reference to FIGS. 3 and 4, and a more detailed description is therefore dispensed with.

In the embodiments shown, the pivoting interlock element 21 bears two stop surfaces, namely the hold-down element 22 and the eccentric 23. However, the invention also relates to a solution in which the pivoting interlock element is provided only with a stop surface, which can be designed like the hold-down element 22, for example. In FIG. 3, it can be seen that the hold-down element 22 is at an angle to an imaginary axis connecting the first receptacle 7 and the second receptacle 8. By virtue of this angularity, the hold-down element 22 exerts on the parting-off grinder 12 a force with components in the direction of the first and the second receptacle 7, 8. The force components are in a certain ratio depending on the angular position of the hold-down element 22, making it possible, given appropriate setting, to dispense with the eccentric 23, with the parting-off grinder 12 nevertheless being pressed reliably into the second receptacle 8. An angle of 45° has proven to be a suitable angular position in this context. In this case, the force components in the direction of the first receptacle 7 and of the second receptacle 8 are of equal magnitude. However, other angles may also be suitable, depending on requirements.

The guide carriage according to the invention is distinguished by the fact that a commercially available parting-off grinder can be secured with great precision and within an extremely short time on the guide carriage without the use of tools and additional fixing elements. By virtue of the preloading produced by the locking device, even the cutting forces which occur during operation can be reliably absorbed without the parting-off grinder moving relative to the frame of the guide carriage. Incorrect mounting is excluded by the simplicity of construction of the holding device.

The fixing of the parting-off grinder is suitable both for parting-off wheels arranged centrally and for those arranged noncentrally on the parting-off grinder.

FIGS. 7 to 11 show another embodiment of the guide carriage, in which, in particular, the locking device has been modified.

Figure 7:
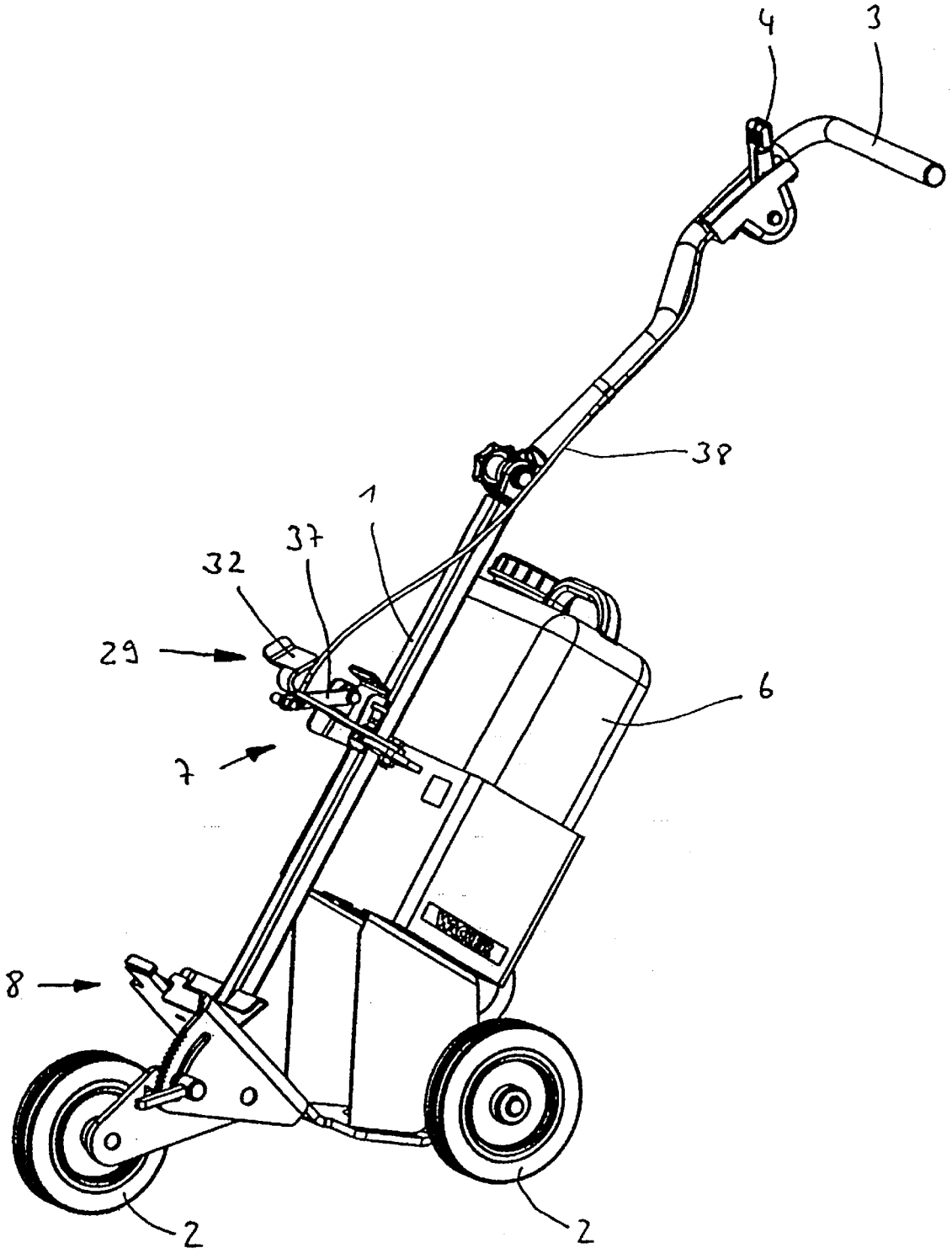
FIG. 7 shows a three-dimensional view of a third embodiment of the guide carriage.
Figure 8:
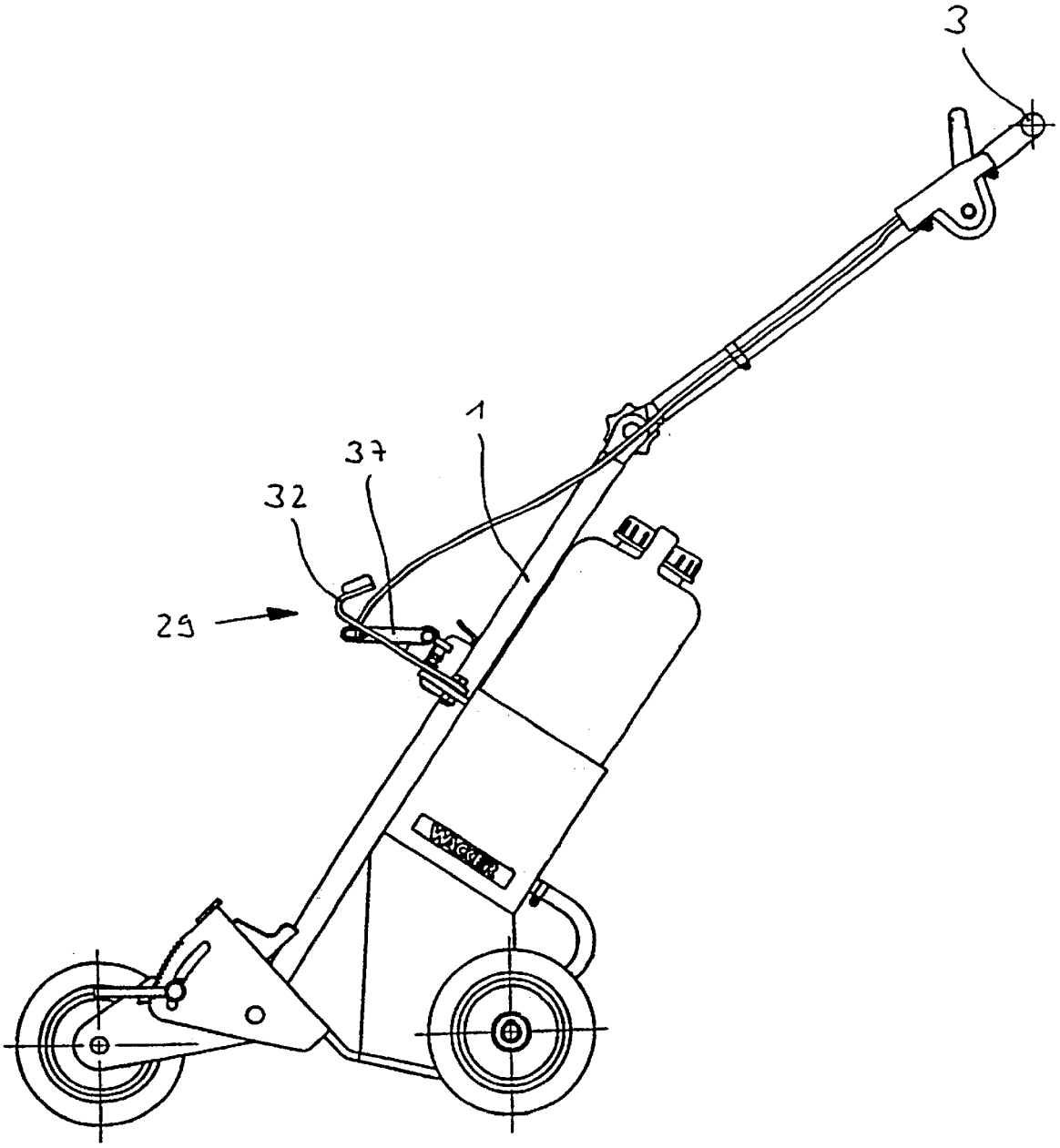
FIG. 8 shows a side view of the guide carriage from FIG. 7.
Figure 9:
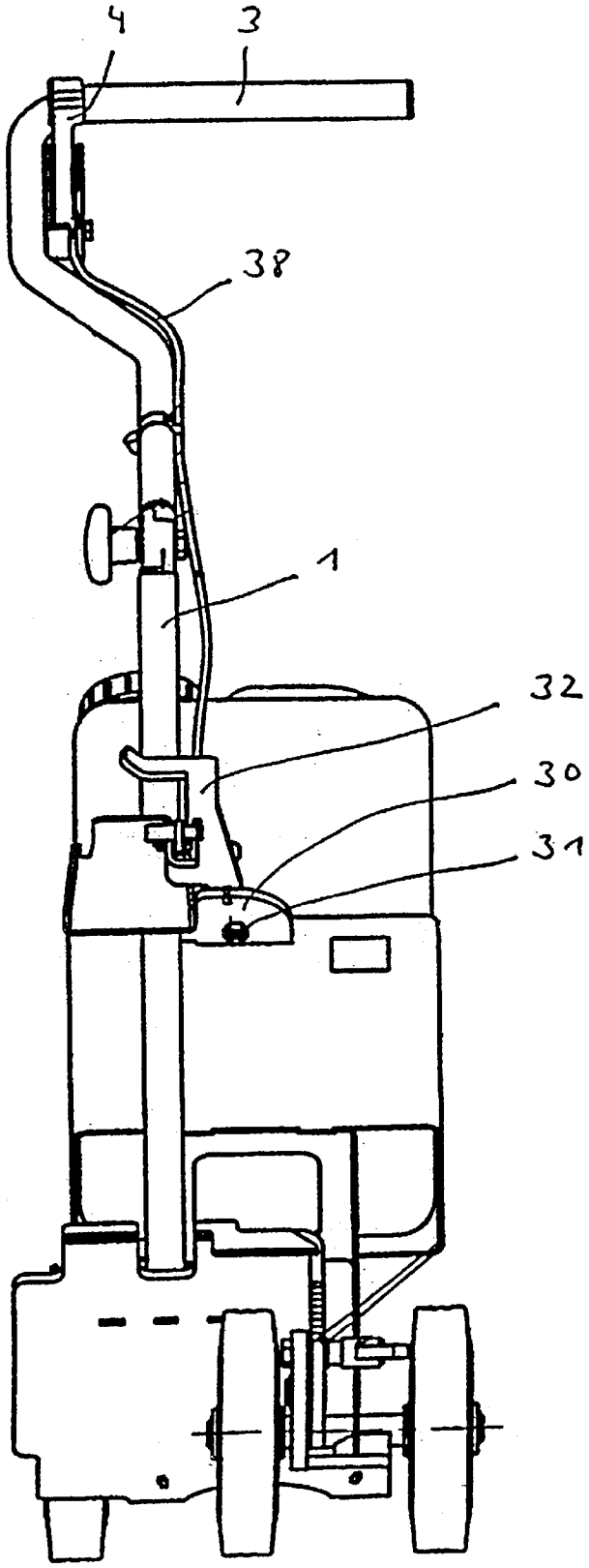
FIG. 9 shows a front view of the guide carriage in FIG. 7.

FIGS. 7 to 9 show the guide carriage in three-dimensional representation, in side view and in front view respectively. Where the same reference numerals as in the previous embodiments are used, the individual subassemblies are not described again.

Figure 10:
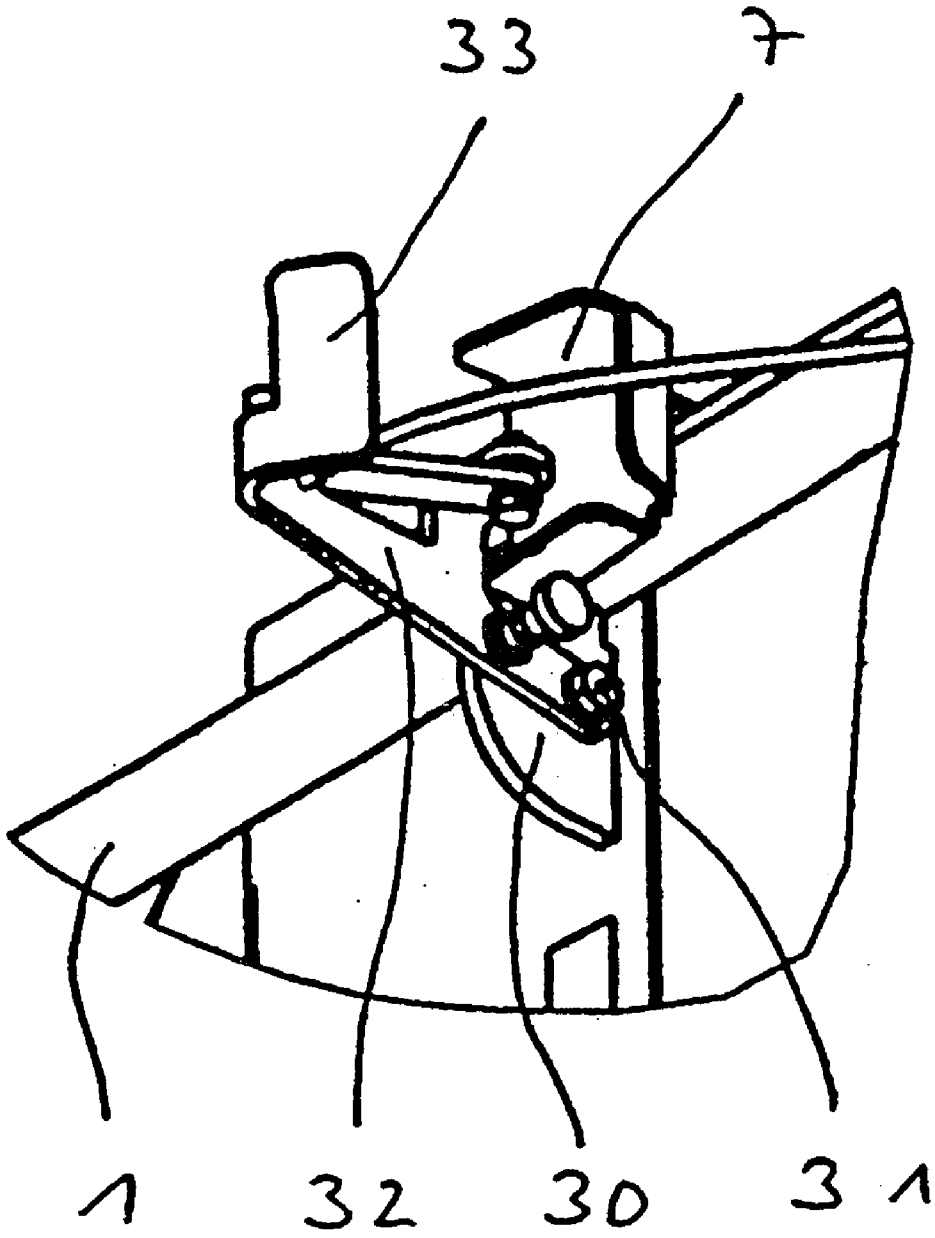
FIG. 10 shows a locking device used in the third embodiment, in three-dimensional view.
Figure 11:
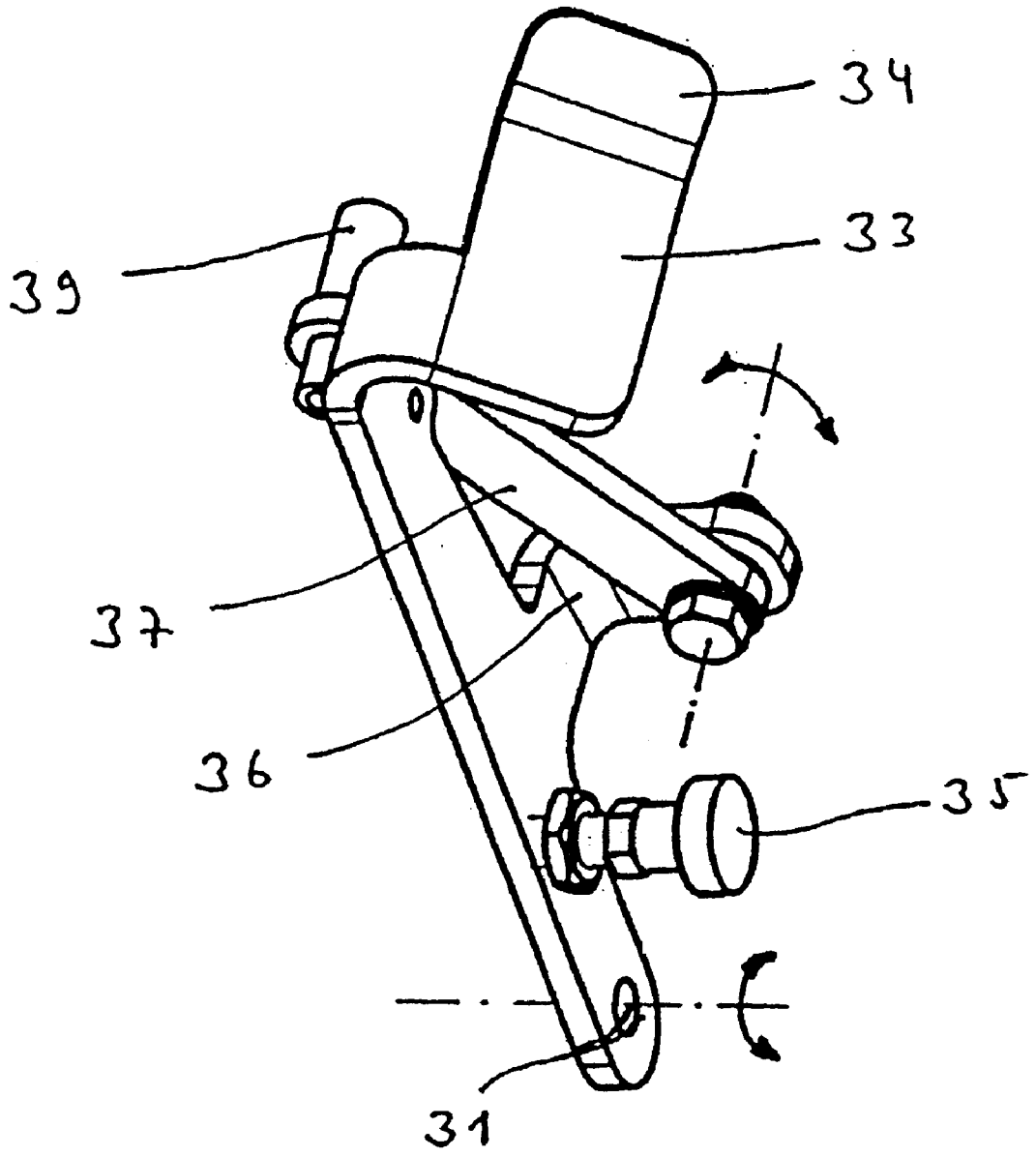
FIG. 11 shows an enlarged representation of the locking device from FIG. 10.

Essentially, this embodiment differs in having a modified locking device 29, which is illustrated on an enlarged scale in FIGS. 10 and 11.

Welded to the frame 1 is a lug 30, which carries a pivoting interlock element 32 which can be pivoted about a pin 31.

At an opposite end from the pin 31, the pivoting interlock element 32 has a stop surface 33 which is bent upward at one end 34 to provide better guidance via the handle of the parting-off grinder. The stop surface 33 corresponds essentially to the stop surface 22 in accordance with FIG. 3.

The pivoting interlock element 32 can be fixed by means of a latching device 35 in at least one end position, in which it presses the parting-off grinder into the holding device. The latching device 35 comprises a spring-loaded pin which can enter a hole (not shown) in the lug 30, thereby bringing about a form-fitting connection between the pivoting interlock element 32 and the lug 30. The form-fitting engagement can be canceled again by pulling on the pin, whereupon the pivoting interlock element 32 is released and can be pivoted.

The pivoting interlock element 32 furthermore has an angled extension 36 on which a throttle actuator 37 in the form of a pivotable lever is mounted. As can be seen, for example, from FIG. 7, the lever of the throttle actuator 37 is coupled to the throttle lever 4 by a Bowden cable 38. The throttle actuator 37 is arranged in such a way that, when the pivoting interlock element 32 is pivoted in, an actuating finger 39 comes to rest against the throttle lever of the parting-off grinder. This makes it possible to remote-control the motor of the parting-off grinder by means of the throttle lever 4.

Thanks to the possibility of pivoting the pivoting interlock element 32 with the throttle actuator 37 toward the parting-off grinder and—on completion of the work—of pivoting it away again from the parting-off grinder to allow the latter to be removed, the parting-off grinder can be installed and removed within the shortest possible time.

By appropriate configuration of the pivoting interlock element 32, it is possible to ensure that the pivoting interlock element 32 with the throttle actuator 37 can only be pivoted in when both the throttle lever 4 and the throttle-actuating means 15 of the parting-off grinder 12 are in the idling position. This ensures that pivoting of the pivoting interlock element 32 is excluded if the parting-off grinder 12 has accidentally already been set operating by pressing the throttle-actuating means 15 and the diamond parting-off wheel 18 is rotating. It is thereby possible to avoid severe accidents. Conversely, the pivoting interlock element 32 can only be pivoted down from the parting-off grinder 12 if all the throttle actuation elements 4, 15, 37 are likewise in the idling position. This prevents the parting-off grinder 12 from being removable during operation with the parting-off wheel 18 rotating.

Figure 12:
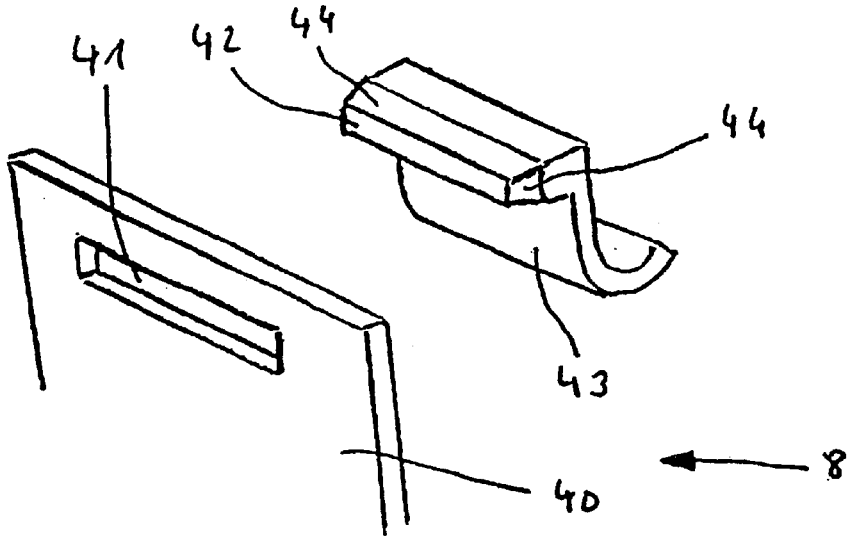
FIG. 12 shows a schematic representation of a fourth embodiment.

FIG. 12 shows schematically the second receptacle 8 of a fourth embodiment. The second receptacle 8 essentially comprises a receiving plate 40, which is secured on the frame 1 of the guide carriage in a manner not shown. An elongate aperture 41, into which a likewise elongate extension 42 of the parting-off grinder 12 (not shown in FIG. 12) can be inserted is formed in the receiving plate 40. The extension 42 is provided on a baseplate 43 of the parting-off grinder 12 and has conical insertion slopes 44 which allow the extension 42 to be inserted easily into the aperture 41 together with the baseplate 43 and the parting-off grinder 12 secured on it. This gives rise to a form-fitting connection between the parting-off grinder 12 and the second receptacle 8.

Figure 13:
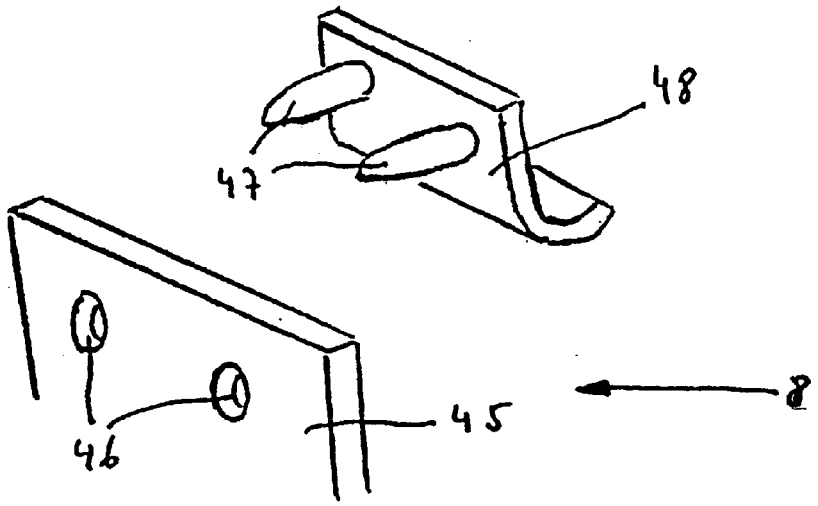
FIG. 13 shows a schematic representation of a fifth embodiment.

FIG. 13 shows a schematic representation, similar to FIG. 12, of a fifth embodiment of the invention, in which the second receptacle 8 has likewise been modified. Two holes 46 have been formed in a receiving plate 45 secured on the frame 1 of the guide carriage. Two conical extensions 47 secured on a baseplate 48 of a parting-off grinder 12 (not shown) can be inserted into the holes 46. This likewise gives rise to a positive-fitting connection between the parting-off grinder 12 and the second receptacle 8.

The second receptacles 8 shown in FIGS. 12 and 13 make it possible to produce positive-fitting engagement between the parting-off grinder 12 and the second receptacle 8 in a particularly simple and reliable manner. The positive-fitting engagement can be released only by pulling the parting-off grinder out in the direction of the first receptacle 7, movement in the direction of the first receptacle 7 being prevented by the stop 21, 32 when the parting-off grinder 12 is inserted and locked.

Other variants of the configuration of the receptacles 7, 8 are, of course, possible. It may be expedient, for example, to provide at least one of the receptacles 7, 8 with a spring device with which a receiving plate is resiliently supported in order, if appropriate, to compensate for any play which occurs and to press the parting-off grinder 12 reliably against the stop 21 or 32. The spring device can be formed by rubber elements, steel-spring straps or other spring elements. However, a spring device of this kind can also be integrated into the baseplate of the parting-off grinder.

Depending on the intended application of the guide carriage, it may furthermore be expedient to provide the stop 21, 32 of the locking device 9, 29 with a spring device in order to compensate for harmful play during the operation of the apparatus. It should be noted that, by virtue of their configuration, the stops 21, 32 described above already have spring properties and are thus capable of compensating for at least a slight play.

In practice, the baseplates 43, 48 shown in FIGS. 12 and 13 can have the disadvantage that the extensions 42, 47 secured on them may be bent or be damaged in some other way if the parting-off grinder 12 is set down roughly on the base, making it more difficult to insert the parting-off grinder 12 into the second receptacle 8. For this purpose, it is advisable to produce corresponding apertures in the baseplates 43, 48 of the parting-off grinder 12, into which apertures extensions formed on the receptacle 8 of the guide carriage then engage. In this case, the apertures in the baseplate 43, 48 can also, for example, take the form of ribs, in the gaps between which corresponding extensions of the second receptacle 8 engage.

What is claimed is:

1. In combination:

a power cutting implement including a casing, a power source supported by the casing, and a cutting tool supported by the casing and powered by the power source; and a hand guided guide carriage for the cutting implement, the guide carriage including a mobile frame and a holding device which is mounted on the frame and which has a first holder and a second holder for supporting the cutting implement on the frame, wherein the first and second holders include first and second receptacles, respectively, for insertion of the cutting implement therein, and wherein the first receptacle is assigned a locking device, with a stop which has at least one stop surface which can be moved relative to the frame and aligned to strike the cutting implement, such that a perpendicular vector associated with the orientation of the stop surface has a directional component extending in a direction of extension of at least one of the first and the second receptacles.

2. A guide carriage for a cutting implement, the guide carriage including a mobile frame and a holding device which is mounted on the frame and which has a first holder and a second holder for supporting the cutting implement on the frame, wherein the first and second holders include first and second receptacles, respectively, for insertion of the cutting implement therein, and wherein the first receptacle is assigned a locking device, with a stop which has at least one stop surface which can be moved relative to the frame and aligned to strike the cutting implement, such that a perpendicular vector associated with the orientation of the stop surface has a directional component extending in a direction of extension of at least one of the first and second receptacles, wherein the stop can be moved relative to the frame and has a first stop surface oriented toward the first receptacle and a second stop surface oriented toward the second receptacle.

3. The guide carriage as claimed in claim 2, wherein the cutting implement is fixed in the first receptacle via the first stop surface, and wherein the cutting implement is pressed against the second receptacle by the second stop surface.

4. The guide carriage as claimed in claim 3, wherein the first stop surface is arranged opposite a bottom surface of the first receptacle.

5. The combination as claimed in claim 1, wherein the second receptacle has supporting surfaces which are arranged in such a way that the second receptacle allows movement of the cutting implement relative to the guide carriage only in the direction of extension of the first receptacle.

6. The combination as claimed in claim 5, wherein a guide surface is provided on the second receptacle opposite a bottom surface thereof.

7. The combination as claimed in claim 1, wherein the first and second receptacles have guide surfaces which slope counter to a direction of insertion of the implement thereon.

8. The combination as claimed in claim 1, wherein a handle for guiding the guide carriage is formed on the frame and wherein the first receptacle is located closer to the handle than the second receptacle.

9. The combination as claimed in claim 1, wherein the stop comprises a pivoting interlock element which bears the first stop surface.

10. The combination as claimed in claim 9, wherein the first stop surface is formed by a hold-down element formed on the pivoting interlock element.

11. A guide carriage for a cutting implement, the guide carriage including a mobile frame and a holding device which is mounted on the frame and which has a first holder and a second holder for supporting the cutting implement on the frame, wherein the first and second holders include first and second receptacles, respectively, for insertion of the cutting implement therein, and wherein the first receptacle is assigned a locking device, with a stop which has at least one stop surface which can be moved relative to the frame and aligned to strike the cutting implement, such that a perpendicular vector associated with the orientation of the stop surface has a directional component extending in a direction of extension of at least one of the first and second receptacles, and wherein the stop comprises a pivoting interlock element which bears the first stop surface, wherein the pivoting interlock element also bears a second stop surface.

12. The guide carriage as claimed in claim 11, wherein the second stop surface is formed by an eccentric which is arranged about a pivot axis of the pivoting interlock element.

13. A guide carriage for a cutting implement, the guide carriage including a mobile frame and a holding device which is mounted on the frame and which has a first holder and a second holder for supporting the cutting implement on the frame, wherein the first and second holders include first and second receptacles, respectively, for insertion of the cutting implement therein, and wherein the first receptacle is assigned a locking device, with a stop which has at least one stop surface which can be moved relative to the frame and aligned to strike the cutting implement, such that a perpendicular vector associated with the orientation of the stop surface has a directional component extending in a direction of extension of at least one of the first and second receptacles, wherein the stop comprises a pivoting interlock element which bears the first stop surface, and wherein the pivoting interlock element can be fixed in at least one locked position via operation of a latching device.

14. A guide carriage for a cutting implement, the guide carriage including a mobile frame and a holding device which is mounted on the frame and which has a first holder and a second holder for supporting the cutting implement on the frame, wherein the first and second holders include first and second receptacles, respectively, for insertion of the cutting implement therein, and wherein the first receptacle is assigned a locking device, with a stop which has at least one stop surface which can be moved relative to the frame and aligned to strike the cutting implement, such that a perpendicular vector associated with the orientation of the stop surface has a directional component extending in a direction of extension of at least one of the first and second receptacles, wherein the stop has a second stop surface, and wherein at least one of the first and the second stop surfaces is moveable via operation of a screw thread.

15. The combination as claimed in claim 1, wherein a safety button is provided on the cutting implement and is actuatable by engagement of the first stop surface with the cutting implement.

16. A guide carriage for a cutting implement, the guide carriage including a mobile frame and a holding device which is mounted on the frame and which has a first holder and a second holder for supporting the cutting implement on the frame, wherein the first and second holders include first and second receptacles, respectively, for insertion of the cutting implement therein, and wherein the first receptacle is assigned a locking device, with a stop which has at least one stop surface which can be moved relative to the frame and aligned to strike the cutting implement, such that a perpendicular vector associated with the orientation of the stop surface has a directional component extending in a direction of extension of at least one of the first and second receptacles, and wherein a throttle actuator, is provided that is moveable with the stop and that is coupled to a throttle lever, is provided on the stop.

17. A guide carriage for a cutting implement, the guide carriage including a mobile frame and a holding device which is mounted on the frame and which has a first holder and a second holder for supporting the cutting implement on the frame, wherein the first and second holders include first and second receptacles, respectively, for insertion of the cutting implement therein, and wherein the first receptacle is assigned a locking device, with a stop which has at least one stop surface which can be moved relative to the frame and aligned to strike the cutting implement, such that a perpendicular vector associated with the orientation of the stop surface has a directional component extending in a direction of extension of at least one of the first and second receptacles, wherein the stop comprises a pivoting interlock element which forms a stop surface and which is pivotable about an axis essentially parallel to a line connecting the first to the second receptacle.

18. The guide carriage as claimed in claim 17, wherein the pivoting interlock element is only pivotable when a throttle actuator of the cutting implement is over the cutting implement or pivoted away from the cutting implement if throttle-actuating device of the cutting implement is in an idling position.

19. The combination as claimed in claim 1, wherein the second receptacle has at least one aperture for the form-fitting reception of a corresponding extension on the cutting implement.

20. A guide carriage for a cutting implement, the guide carriage including a mobile frame and a holding device which is mounted on the frame and which has a first holder and a second holder for supporting the cutting implement on the frame, wherein the first and second holders include first and second receptacles, respectively, for insertion of the cutting implement therein, and wherein the first receptacle is assigned a locking device, with a stop which has at least one stop surface which can be moved relative to the frame and aligned to strike the cutting implement, such that a perpendicular vector associated with the orientation of the stop surface has a directional component extending in a direction of extension of at least one of the first and second receptacles, wherein at least one of the receptacles has at least one extension for engagement in an associated aperture in the implement.

21. A guide carriage for a cutting implement, the guide carriage including a mobile frame and a holding device which is mounted on the frame and which has a first holder and a second holder for supporting the cutting implement on the frame, wherein the first and second holders include first and second receptacles, respectively, for insertion of the cutting implement therein, and wherein the first receptacle is assigned a locking device, with a stop which has at least one stop surface which can be moved relative to the frame and aligned to strike the implement, such that a perpendicular vector associated with the orientation of the stop surface has a directional component extending in a direction of extension of at least one of the first and second receptacles, wherein at least one of the receptacles has a spring device for the resilient reception of the cutting implement.

22. In combination:

a power cutting implement including a casing, a power source supported by the casing, and a cutting tool supported by the casing and powered by the power source; and a guide carriage including a mobile frame;

a holding device mounted on the frame and having first and second holders for supporting the cutting implement on the frame, wherein the first and second holders comprise first and second receptacles, respectively, a locking device including a stop having at least one stop surface which is movable relative to the frame to strike the cutting implement, wherein the stop is arranged such that a perpendicular vector associated with the orientation of at least one stop surface has a directional component extending in a direction of extension of at least one of the first and the second receptacles.

23. The combination as claimed in claim 22, wherein the stop also has a second stop surface urging the cutting implement in the direction of extension of the second receptacle.

24. The combination as claimed in claim 22, wherein the first stop surface urges the cutting implement in a common direction of extension of the first and second receptacles.

* * * * *